United States Patent [19]

Orchard et al.

[11] Patent Number: 4,573,721

[45] Date of Patent: Mar. 4, 1986

[54] SECURITY LOCK

[75] Inventors: Melvin C. Orchard; Michael Rogers, both of Salt Lake City, Utah

[73] Assignee: The Joint Lock Corporation, Salt Lake City, Utah

[21] Appl. No.: 600,889

[22] Filed: Apr. 16, 1984

[51] Int. Cl.[4] ..... E05C 1/04

[52] U.S. Cl. ..... 292/145

[58] Field of Search ..... 292/144, 183, 189, 145, 292/149, 152, 340, 346

[56] References Cited

U.S. PATENT DOCUMENTS

| | | | |
|---|---|---|---|
| 889,484 | 6/1908 | Parker | 292/149 |
| 1,230,740 | 6/1917 | McCracken | 292/149 |
| 1,626,482 | 4/1927 | Sargent | 292/145 |
| 1,720,042 | 7/1929 | Hankwitz | 292/145 |
| 2,251,038 | 7/1941 | Danen | 292/145 |
| 2,717,064 | 9/1955 | Hock | 292/183 X |

*Primary Examiner*—Richard E. Moore

*Attorney, Agent, or Firm*—Thorpe, North & Western

[57] ABSTRACT

A locking mechanism for securing the upper swinging edge corner of a door to the adjacent door jamb joint comprises a housing holding a flat sliding latch mounted at an angle on the door corner. The latch slides toward and past the door corner and has converging leading edges normal to each other such that they meet at an apex. One leading edge is parallel with the top of the door and the other leading edge is parallel with the swinging side of the door. Receiver means are contained in the corner of the door jamb having receiving channels in alignment with the leading edges of the latch such that when the latch is pushed forward in the housing, the leading edges of the latch are received into and held in the receiving channels. Forces exerted against the locking mechanism when the latch is secured in the receiving channels are distributed along both the top and side edges of the door and door jamb instead of at a single pressure point.

4 Claims, 4 Drawing Figures

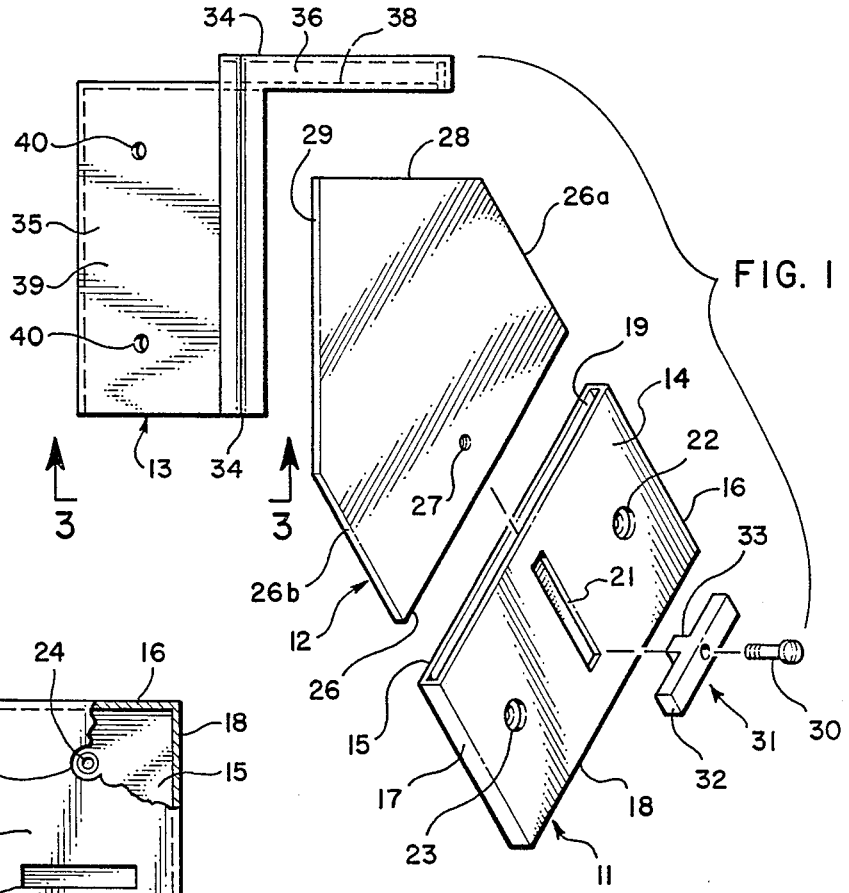
FIG. 1
FIG. 2
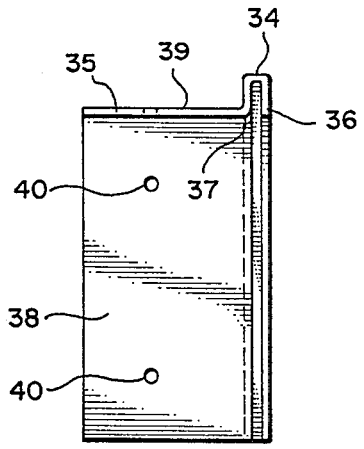
FIG. 3
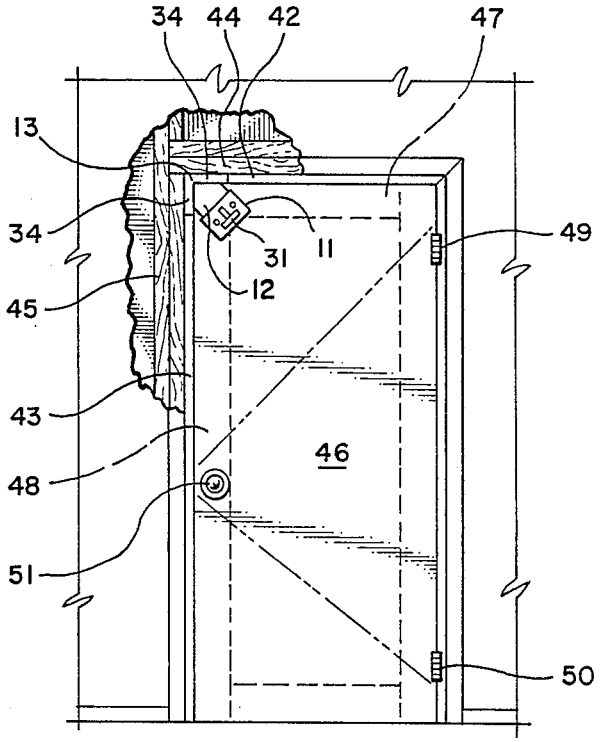
FIG. 4

SECURITY LOCK

BACKGROUND

The present invention relates to a security lock for hinged doors and, more particularly, to a mechanism which both locks and reinforces a door.

Mechanisms presently available for locking a hinged door are usually sufficient to prevent casual or inadvertent opening of the door. Even locking mechanisms employed on exterior doors are hardly strong enough to resist a determined effort at entry. Consequently, various supplementary mechanisms, such as chains, dead bolts, etc., have been proposed to provide a security against unauthorized opening of a door. The degree of security offered by such mechanisms has often proved to be illusory, since either the mounting of the mechanism is inadequate or the door and/or the supporting frame are weakened by installation of the mechanism. With door chains and some bolts, a portion of the mechanism is often attached to the casing surrounding the door where it can be dislodged by a sudden blow. Other bolts are received in holes drilled in the frame or receptacles attached to the frame. In either case, where is essentially point contact between the bolt and the frame, such that force applied to the door is concentrated at a single point on the frame.

For ease of operation, it has been the practice to install the supplementary mechanisms in the immediate vicinity of the locking mechanism, i.e., approximately midlength of the swinging edge of the door. While the hinged edge is supported by the hinges at widely spaced locations near the top and bottom of the frame, the swinging edge is supported by the locking and supplementary mechanisms which are closely spaced and concentrated in one area of the frame. Thus, pressure applied at the swinging edge of the door is concentrated within a small area of the frame creating enormous forces which can splinter the frame and dislodge the various mechanisms.

OBJECTS AND SUMMARY OF THE INVENTION

An object of the present invention is to provide a security lock for a hinged door which avoids concentration of locking forces in the supporting frame to a single location.

Another object is to provide a security lock which reinforces and strengthens the locking of a hinged door.

A further object is to provide a security lock which facilitates placement thereof at hitherto unsupported areas of a hinged door.

The above and other unspecified objects are realized in the present invention by provision of a security lock in which contact between movable locking latch contained on the door and the fixed receiver adjacent the door occurs along intersecting perpendicular lines of substantial length, so that forces exerted against the lock are distributed along the supporting frame in two directions. The receiver and latch are additionally configured to facilitate placement in a corner of the frame to reinforce and strengthen the swinging edge of the hinged door.

DRAWING

The best mode presently contemplated of carrying out the invention will be understood from the detailed description of the several embodiments illustrated in the accompanying drawings, in which:

FIG. 1 is an exploded view in perspective of a security lock according to the present invention;

FIG. 2 is an elevation view of the housing of FIG. 1;

FIG. 3 is an end plan view of the receiver taken along lines 3—3 of FIG. 1; and FIG. 4 is an elevation view of door with a security lock in place.

DETAILED DESCRIPTION OF THE ILLUSTRATED EMBODIMENTS

Referring to FIG. 1 of the drawing, the security lock is illustrated as including a housing 11, a latch 12, and a receiver 13. The housing 11 is a thin rectangular, impact resistant enclosure having planar upper and lower surfaces 14 and 15, respectively, joined by side walls 16 and 17 and a rear end wall 18. An elongated, narrow slot 19 at the front end opens to the interior of the housing. A narrow, transverse slot 21 parallel to sides 16 and 17 is provided in the upper surface 14 along the approximate midline of the housing. One or more access openings 22 and 23 are provided in the upper surface adjacent each side and counter-sunk screw holes 24 and 25 are provided in the lower surface 15 in alignment with the access openings 22 and 23. The latch 12 is a flat plate of strong, stiff material, such as steel, which is dimensioned to be received through slot 19 within the interior of the housing 11 with close tolerance. The trailing edge 26 of the latch is perpendicular to side edges **26*a* and 26*b* and an internally threaded hole 27 is provided in the plate adjacent the trailing edge. The leading edge of the latch is generally triangular with convergent surfaces 28 and 29, joining at right angles at the apex. The trailing edge 26 of the latch is inserted through slot 19 in the housing and a handle 31 is secured in place. The handle 31 includes a cross-piece 32 joined to a rectangular shank 33. The shank 33 is positioned in transverse slot 21 against the latch and is attached to the latch by means of a bolt 30 passed through the cross-piece 32 and shank 33 and threadedly received within hole 27. The latch can be extended from the housing or withdrawn therein by sliding the handle 31 along the slot 21**.

The receiver 13 includes an elongated, narrow channel 34 and an integral mounting flange 35. The receiver is a sheet of strong, stiff metal, such as steel, one edge of which is stamped, or otherwise formed, to produce the channel 34. The channel protrudes laterally from the flange with the edges 36 and 37 of the channel lying approximately in the plane of the flange, so that the channel extends over the full length of the receiver and opens to one side of the flange. The channel is dimensioned to receive the convergent surfaces 28 and 29 of the leading edges of the latch 12. The full lengths of the leading edges of the latch are received within the channel 34 to a substantial depth. The sheet from which the receiver 13 is made is formed at approximate right angles along its approximate midlength to provide two sections 38 and 39 which are approximately normal to each other and which contain apertures 40. The included angle between sections 38 and 39 corresponds to the angle of convergence between surfaces 28 and 29 of the latch, so that the latch leading edges will be firmly received within the channel 34 over the full lengths thereof.

The latch receiver 13 is adapted to be installed in a corner of the door jamb at the intersection of the head jamb 42 and side jamb 43 adjacent the swinging edge side of the door. The sections 38 and 39 of the mounting flange are recessed into the head and side jambs 42 and 43 with the channel 34 overlapping the edges thereof. The bottom of the channel bears against the edges of the head and side casings or is recessed into them, depending upon the position of the casings. Flat headed screws are placed in the openings 40 to attach the sections to the jambs. In this respect, the screws should be of sufficient length to extend through the head and side jambs and firmly engage the header 44 and studding 45 to firmly anchor the receiver. The housng 11 is positioned on the upper corner of the swinging edge of the door 46 and secured in place by means of flat headed screws embedded within the top rail 47 and stile 48 of the door. When the housing is properly positioned on the door, the screws are placed in holes 24 and 25 through access openings 22 and 23 and screwed into the door. When the latch 12 is extended into the channel 34 of the receiver 13, the upper corner of the door 46 is securely locked to the door jamb.

As indicated in FIG. 4, the strongest part of a hinged door is that portion enclosed within straight dashed lines extending between the points of support for the door, i.e., between the hinges 49, 50 and the conventional locking mechanism 51. Since the locking mechanism is located slightly below the midportion of the swinging edge of the door and since supplementary mechanisms such as deadbolts, are usually located immediately adjacent to the locking mechanism, the lines of strength converge from top and bottom hinges across the door to the locking mechanism area. When force is applied against the swinging edge of the door, it is concentrated in the area of the side jamb 43 and stile 48 where the locking and supplementary mechanism are installed. In the usual case, the upper and lower parts of the door, above and below the dashed lines of FIG. 4, are unsupported and facilitate the concentration of forces in the area of the locking mechanism. The concentration of force in such a limited area often causes the door or jamb to give way and permit unauthorized opening.

With the present security lock, the upper corner of the swinging edge of the door is firmly anchored to the door frame, so that force applied to the door is not concentrated in one area, but is resisted at two points spaced from each other. The door is thus strengthened along both the swinging and top edges and reinforced by the strength of the security lock itself. In this regard, the right angles of the latch leading edges engage the receiver over its full width, so that any force exerted against the swinging or top edges is spread evenly over the length of the receiver and is not concentrated at one point.

To prevent the latch 12 from becoming dislodged from the receiver 13, the receiver may be formed of a magnetizable material, such as iron, steel or stainless steel, and then strongly magnetized. Alternatively, a small leaf spring may be placed within the housing on the lower surface to load the latch toward the upper surface. The trailing edges of the access openings can be depressed slightly to contact the trailing edge of the latch and form a positive stop to maintain the latch in its extended position. The latch can be released by applying pressure on the handle against the leaf spring.

We claim:

1. A security locking mechanism for securing the upper swinging edge corner of a door to the adjacent door jamb corner comprising in combination:

(a) a generally rectangular housing adapted to be attached to the inside surface of said door corner and having parallel upper and lower flat surfaces, said surfaces being separated by interconnecting parallel sidewalls and a rear endwall and having an open front end, said upper surface containing an open elongated slot parallel to said sidewalls through which a latch handle may be inserted;

(b) a flat latch slidably engaged in said housing through said open front end between said upper and lower surfaces, said flat latch having a trailing edge, parallel side edges at right angles to said trailing edge and converging leading edges depending forwardly and inwardly from said side edges and joining at right angles at a forward apex;

(c) a latch handle inserted through the open elongated slot in said upper surface of said housing and secured to said flat latch to allow said latch to be slid within said housing along the length of said open elongated slot; and (d) a receiver mountable to said door jamb corner consisting of contiguous flat flange sections depending from each other at right angles which, when mounted in said door jamb corner will have surfaces normal to the inner surface of said door, said flange sections containing apertures through which attachment means may be inserted to secure said flanges to the door jamb, said flange sections containing a forward edge and a rear edge, an elongated channel contiguous with and extending around the forward edge of said flange sections, said elongated channel extending backwardly from said flange sections so as to be toward said door jamb corner when mounted and opening forwardly at right angles so as to be toward said door corner when mounted, said elongated channel being adapted to receive said converging leading edges of said flat latch when said flat latch is moved forwardly through said housing by means of said latch handle.

2. A security locking mechanism according to claim 1 wherein said flat latch and receiver are made of a magnetized material such that said latch will be firmly held in said elongated channel by magnetic force when inserted therein.

3. A security locking mechanism according to claim 2 wherein aligned apertures are provided in said upper and lower surfaces through which attachment means may be inserted to secure said housing to said door.

4. A security locking mechanism according to claim 3 wherein a threaded aperture is provided in said flat latch adjacent said trailing edge midway between said side edges and in alignment with said elongated slot in the housing, said latch handle being secured to said flat latch by attachment means received within said threaded aperture.

* * * * *